US005679745A

United States Patent [19]

Hamada et al.

[11] Patent Number: 5,679,745

[45] Date of Patent: Oct. 21, 1997

[54] GOLF BALL

[75] Inventors: Akihiko Hamada, Kakogawa; Yoshikazu Yabuki, Shirakawa, both of Japan

[73] Assignee: Sumitomo Rubber Industries, Ltd., Hyogo-ken, Japan

[21] Appl. No.: 523,892

[22] Filed: Sep. 6, 1995

[30] Foreign Application Priority Data

Sep. 6, 1994 [JP] Japan ..... 6-239525

[51] Int. Cl.[6] ..... A63B 37/12; C08L 33/02

[52] U.S. Cl. ..... 525/195; 525/196; 525/201; 525/212; 525/221; 473/372; 473/378; 473/385

[58] Field of Search ..... 525/195, 196, 525/221, 201, 212; 473/372, 378, 385

[56] References Cited

U.S. PATENT DOCUMENTS 4,965,319 10/1990 Kawamoto .
4,986,545 1/1991 Sullivan .
5,064,903 11/1991 Peiffer .
5,098,105 3/1992 Sullivan .
5,187,013 2/1993 Sullivan .
5,294,672 3/1994 Peiffer .
5,330,837 7/1994 Sullivan .
5,359,000 10/1994 Hamada et al. .

*Primary Examiner*—David Buttner
*Attorney, Agent, or Firm*—Birch, Stewart, Kolasch & Birch, LLP

[57] ABSTRACT

The present invention provides a golf ball which does not cause poor impact resilience but provides long distance carry as well as good hit feeling, and keeps controllability nearly similar to balata covered thread wound golf balls. The present invention provides a golf ball which comprises a core and a cover for covering the core, wherein the cover comprises, as base component, a mixture of a sulfonate-type ionomer of which a polymer chain contains an elastomeric portion having rubber resilience and has a sulfonic group neutralized by a metallic ion, and a carboxylate type ionomer which is a copolymer of at least α-olefin and α,β-unsaturated carboxylic acid of which a carboxyl group is neutralized by a metallic ion.

3 Claims, 2 Drawing Sheets

GOLF BALL

FIELD OF INVENTION

The present invention relates to a golf ball, and more particularly, it relates to a golf ball which provides a long distance carry and excellent hit feeling and controllability.

BACKGROUND OF THE INVENTION

In recent years, carboxylate-type ionomers obtained by neutralizing a copolymer of α-olefin and α,β-unsaturated carboxylic acid with metallic ion have been extensively used as base components of a golf ball cover (Japanese Kokoku Publication Sho 49-27093). A typical chemical formula of the carboxylate-type ionomer is shown as follows.

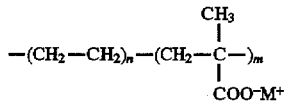

The reason why the carboxylate-type ionomer has been used for base components of the cover as described above is that the carboxylate-type ionomer has excellent durability, excellent cut resistance, excellent impact resilience and good processability.

However, the grades of carboxylate-type ionomers that are suitable for the golf ball covers have a poor hit feeling and controllability (e.g., easiness to spin) that are inferior to those of balata (transpolyisoprene), which has been used as a cover for thread-wound balls, although it has high hardness and rigidity.

Consequently, various attempts have been made to improve the hit feeling and controllability by softening the carboxylate-type ionomer by various methods but satisfactory results have not been obtained.

As a typical example of these improving techniques, Japanese Kokai Publication Hei 1-308577 discloses that a carboxylate-type ionomer resin which has been conventionally used is blended with another carboxylate-type soft ionomer resin into which an acrylic ester is copolymerizably introduced to improve hit feeling and controllability. However, the soft ionomer resin used in the method only achieves low rebound performance because the ionic association structure (ionic crosslinking structure) which assumes to provide high rebound performance of the ionomer is disturbed by introduction of the third component (acrylic ester). Consequently, the cover containing the soft ionomer has serious defects in impact resilience and short carry distance.

OBJECTS OF THE INVENTION

Figure 1:
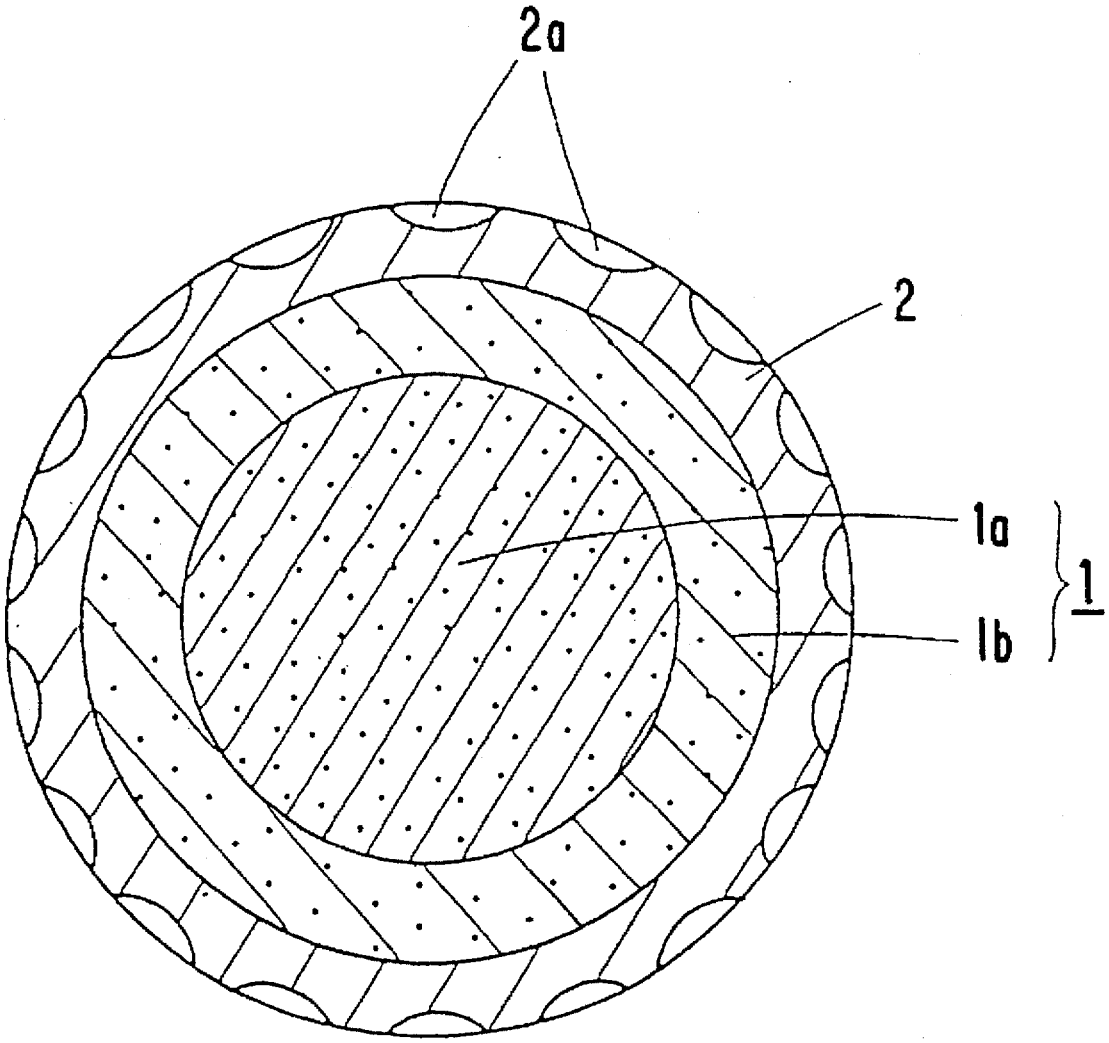
FIG. 1 is a cross sectional view schematically showing one example of a golf ball according to the invention.

It is an object of the present invention to provide a golf ball which does not cause poor impact resilience but provides long distance carry as well as good hit feeling, and keeps controllability nearly similar to balata covered thread wound golf balls.

SUMMARY OF THE INVENTION

The inventors of the present invention have actively investigated for cover materials which provide a good hit feeling and controllability similar to that of a balata cover, and which at the same time does not cause a reduction in impact resilience. Accordingly, the present invention relates to a golf ball which comprises a core and a cover for covering the core, wherein the cover comprises, as base component, a mixture of a sulfonate-type ionomer having a polymer chain that contains (i) an elastomeric portion having rubber resilience and a sulfonic group neutralized by a metallic ion, and (ii) a carboxylate type ionomer that is a copolymer of at least an α-olefin and an α,β-unsaturated carboxylic acid having a carboxyl group is neutralized by a metallic ion

DETAILED DESCRIPTION OF THE INVENTION

The invention will be described more in detail as follows. The point in which the invention most greatly differs from conventional techniques is that a sulfonate-type ionomer is used as a soft material. The general chemical structure of the sulfonate-type ionomer is shown as follows.

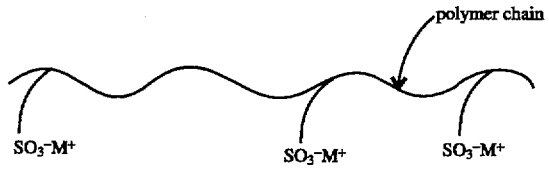

The sulfonate-type ionomer used in the invention exhibits much stronger ion cohesion than do conventionally used carboxylate-type ionomers, and accordingly, even if the content of sulfonate metal salt is so low as to scarcely affect the characteristics of the polymer chain, a strong ion crosslinking structure is still formed. Since the sulfonate-type ionomer which contains an elastomer portion in the polymer chain has rubber-like flexibility and rubber resilience, the resulting cover shows good impact resilience. Although the carboxylate-type soft ionomer resin reduces impact resilience, the sulfonate-type ionomer resin used in the present invention can provide a soft material which has both thermoplasticity and high durability, and which does not reduce impact resilience.

The sulfonate-type ionomer used in the invention must have an elastomer portion in at least a portion of the polymer chain, to impart proper flexibility and impact resilience to the cover.

Examples of the elastomer portion include ethylene-propylene-diene monomer copolymer elastomer (EPDM), styrene-hydrogenated butadiene-styrene block copolymer thermoplastic elastomer, styrene-hydrogenated isoprene-styrene block copolymer thermoplastic elastomer, polybutadiene, polyisoprene, styrene butadiene rubber (SBR), acrylonitrile butadiene rubber (NBR), and other diene rubbers. In view of compatibility with carboxylate-type ionomer containing olefin, preferred are saturated hydrocarbon-type elastomers such as ethylene-propylene-diene monomer copolymer elastomer, styrene-hydrogenated butadiene-styrene block copolymer thermoplastic elastomer, styrene-hydrogenated isoprene-styrene block copolymer thermoplastic elastomer, and the like.

The desirable concentration of the neutralized sulfonic acid group contained in the sulfonate type ionomer may be 0.2–3.0 mol%. If the concentration of sulfonic acid group is lower than 0.2 mol%, formation of metallic ion crosslinking is insufficient and satisfactory impact resilience and strength are unable to be obtained, while if the concentration of sulfonic acid group is higher than 3.0 mol%, thermal plasticity (fluidity) is impaired and it may be difficult to form a cover. The "mol% of sulfonic acid group" referred to herein means a molar number of sulfonic acid group per 1 mol of the monomers constituting the polymer chain, which is multiplied by 100.

Examples of the metallic ion for neutralizing the sulfonate-type ionomer are various metallic ions (metallic cations) including alkaline metals such as lithium, sodium, and potassium, alkaline earth metals such as calcium and magnesium, transition metallic ions such as zinc, cobalt, copper, and nickel. Among them, zinc ion is particularly preferred because of good melt-processability and excellent effects for improving strength.

The sulfonate-type ionomer resin can be easily synthesized by reacting the elastomer portion with acetyl sulfuric acid formed from anhydride acetic acid and concentrated sulfuric acid in a solution to attach sulfonate groups to the elastomer portion, and then neutralizing by adding metallic acetate or hydroxide to the solution. In addition to the solution reaction, it can also be synthesized by bulk reaction using an extruder, etc. In such events, since free sulfonic acid attached to the polymer chain is thermally unstable, it is preferably neutralized 100% by the metallic ion.

In the present invention, a base material for the cover having appropriate rigidity and hardness is obtained by blending the soft sulfonate-type ionomer having high impact resilience and high strength with a conventional carboxylate-type ionomer.

Typical examples of the carboxylate-type ionomer are a copolymer formed from 10–20% by weight α,β unsaturated carboxylic acid having 3–8 carbons and 80–90% by weight α-olefin, of which a part of carboxyl group is neutralized with metallic ion (ion of sodium, lithium, potassium, zinc, magnesium, etc.). The carboxylate-type ionomer is commercially available, including a metallic-ion neutralized ionomer of ethylene and methacrylic acid copolymer, i.e. "Himilan" from Mitsui du Pont Poly Chemicals Company Ltd., "Surlyn" from du Pont Co. in USA, and a metallic-ion neutralized ionomer of ethylene and acrylic acid copolymer, i.e. "Iotec" from Exxon Chemical Co.

Among the ionomers mentioned above, grades which can particularly be used desirably in the invention is Hi-milan 1605, Hi-milan 1706, Hi-milan 1707, Hi-milan 1555, Hi-milan 1557, Hi-milan AM7311, Surlyn 7940, Surlyn 7930, Iotec 8000, and Iotec 7010 (all of them are commercial names), and they can be used independently or in a mixture of two or more.

In the carboxylate-type ionomer, there are soft one obtained from a copolymer of an α,β unsaturated carboxylic acid, an α-olefin and an unsaturated carboxylic ester, but its use should be limited to only a part for adjusting hardness because impact resilience becomes poor. The soft carboxylate-type ionomer has already been commercially available, for example, under the name of Hi-milan 1855 and Hi-milan 1856 (all of them are commercial names) from Mitsui du Pont Poly Chemicals Co., Ltd.

Since the cover using a mixture of the sulfonate-type ionomer and the carboxylate-type ionomer is characterized by a capability to be formulated to have properties close to those of a balata cover, it is desirable to adjust to 100–250 MPa of stiffness modulus and 40–55 Shore D hardness in view of hit feeling and controllability.

The mixing ratio of sulfonate-type ionomer to carboxylate ionomer is not particularly limited if the above physical properties can be obtained, but in general, it is desirable to adjust 10:90–60:40 by weight ratio of a weight ratio of sulfonate type ionomer to carboxylate ionomer.

The golf ball cover of the invention is composed of a mixture of the sulfonate-type ionomer and the carboxylate ionomer as described above as base components, which are mixed using a plastic extruder or an internal mixer such as a plast mill, a banbury mill, a kneader, and the like. The cover may contain various additives, such as pigments (e.g. titanium dioxide), dispersants, melt viscosity adjusters, inorganic filler, antioxidant, ultraviolet absorbents, photostabilizers, and the like, in addition to the base components comprising the specific ionomer mixture. And another resin may be added to an extent that would not impair characteristics of the base component comprising the specific ionomer mixture. The specific sulfonate-type ionomer and carboxylate-type ionomer comprising the base component of the cover are only required to be present in a blended state in the cover, and for example, they may be blended in advance or may be blended together with other additives such as pigments when the cover are prepared.

In the present invention, the cover can be applied to either a core for solid golf balls (solid core) an or a core for thread-wound golf balls (thread-wound core).

For the solid core, not only one-layer core but also multi-layer structure core with two or more layers may be accepted. The two piece solid golf ball core can be prepared by mixing 100 parts by weight of polybutadiene rubber, 10–60 parts by weight of α,β-monoethylenically unsaturated carboxylic acid such as acrylic acid, methacrylic acid and the like or their metallic salts, cross-linking agent such as functional monomer including trimethylolpropane trimethacrylate independently or all together, 10–30 parts by weight of fillers such as zinc oxide, barium sulfate, and the like, and 0.5–5 parts by weight of peroxides such as dicumyl peroxide and the like, and if necessary, in addition, 0.1–1 parts by weight of an antioxidant to form a rubber composition which is then press-vulcanized (crosslinked) at a temperature of 140 to 170° C. for 10 to 40 minutes to obtain a spherical cured article.

The thread-wound core comprises a center and a thread rubber layer wound around the center. The center can be either a liquid center or a rubber center. The rubber center is, for example, obtained by curing a rubber composition similar to those of the solid core.

The thread rubber which has hitherto been used can be used. For example, a thread rubber which is obtained by mixing natural rubber or a mixture of natural rubber and synthesized polyisoprene, an antioxidant, a curing accelerator, ion and the like to form a rubber composition, followed by vulcanizing it can be used. However, these solid cores and thread-wound cores are only illustrative and shall not be limited thereto.

The method for covering a cover on the core shall not be particularly limited but can be any conventional method. For example, a cover composition obtained by mixing the specific ionomer mixture as a base material and other required additives is formed into semi-spherical half shells in advance, and using two of them, the core is wrapped and pressure-formed for 1–15 minutes at 130–170° C. or the cover composition is directly injection-molded to wrap the core. The thickness of the cover is, in general, about 1–4 mm. At the time of cover forming, dimples are also formed on the ball surface as required, or finished with paint, or stamped as required.

Referring now to the drawings, the structure of the golf ball according to the invention will be described in detail hereinafter.

FIG. 1 is a cross sectional view schematically illustrating an example of the golf ball according to the invention. The golf ball shown in FIG. 1 is a thread-wound golf ball, and in FIG. 1, numeral 1 denotes a core comprising a center 1*a* and thread rubber 1*b*, 2 is a cover, and 2*a* is dimples.

The center 1*a* or thread rubber 1*b* are not particularly limited to specific ones but the center and thread rubber similar to those used hitherto can also be used. As the center 1*a*, either liquid or rubber center can be used, around which the thread rubber 1*b* is wound in the stretched state, thereby forming a core 1 called thread-wound core. The cover 2 is covered on the core 1, and the cover 2 is formed from a mixture of the specific sulfonate-type ionomer and carboxylate-type ionomer as base material component.

Figure 2:
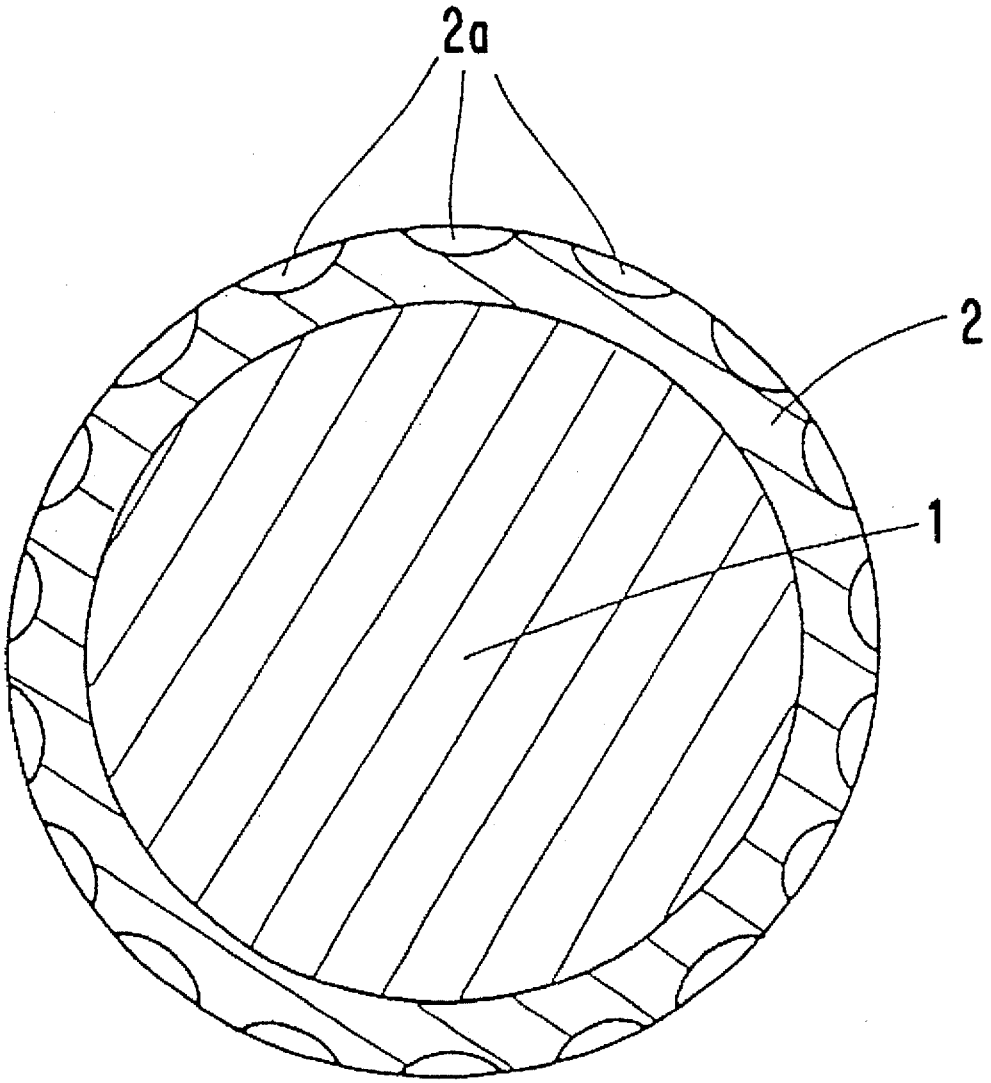
FIG. 2 is a cross sectional view schematically showing another example of a golf ball according to the invention.

FIG. 2 is a cross sectional view schematically indicating another example of the golf ball according to the invention. The golf ball shown in FIG. 2 is a two-piece solid golf ball comprising a core 1 formed from a cured articled of a rubber composition and a cover 2 covering the core 1. The core 1 is called a solid core but is not particularly limited to a specific one but, for example, a cured article of a rubber composition comprising butadiene as described above as a main material is suitably used. The cover 2 is formed from a mixture of the specific sulfonate-type ionomer and carboxylate-type ionomer used as base material component. Numeral 2*a* is dimples formed on the cover 2. In the golf ball shown in the FIG. 2, the core 1 comprises a cured article of a rubber composition with one-layer structure, but in place of it, for example, a two-layer structure solid core may be use, in which an outer core comprising a cured article of a rubber composition using polybutadiene as a main material is formed around an inner core comprising a cured article of a rubber composition using polybutadiene as a main material.

The dimples 2*a* are formed on the cover 2 of the golf ball in a suitable quantity and in a suitable form as required or so as to obtain desired characteristics, and these golf balls may have their surfaces painted or marked as required.

EXAMPLES

The invention will be more specifically described with reference to the following examples. However, it is to be understood that the invention is not intended to be limited to the specific examples.

Examples 1–6 and Comparisons 1–4 (Thread-wound Golf Balls)

Through the process (1) to (3) shown as follows, thread-wound golf balls of Examples 1–6 and Comparisons 1–4 were prepared.

(1) Preparation of thread-wound core:

To a liquid center having a diameter of 28.1 mm comprising a paste containing barium sulfate dispersed in water and a cover rubber of 1.7-mm cured natural rubber which wraps the paste, thread rubber made from blend rubber in which natural rubber and low cis-isoprene rubber (commercially available from Shell Chemical Company as SHELL IR-309) were blended at a ratio of 50 to 50 by weight was wound to form a thread-wound core having a diameter of 39.5 mm.

(2) Preparation of the cover compositions

The components shown in Table 1 and Table 2 were mixed by a twin-screw kneading type extruder to form a pellet-form cover composition. Table 1 shows the components of the cover composition of Preparation Examples 1–6 used for golf balls of Examples 1–6 and a stiffness modulus and Shore D hardness of the cover, and Table 2 shows the component of the cover composition of Comparative Preparation Examples 1–4 used for golf balls of Comparisons 1–4 and a stiffness modulus ratio and a Shore D hardness of the cover. The stiffness modulus and Shore D hardness of the cover were measured in accordance with ASTM D-747 for the stiffness modulus and in accordance with ASTM D-2240 for Shore D hardness, using hot-press-formed sheets about 2 mm thick stored at 23° C. for two weeks. Extrusion conditions were screw diameter: 45 mm; screw rotating speed: 200 rpm; screw L/D=35; and temperature of composition at the die position: 200–250° C.

Now description will be made on the cover composition of Comparative Preparations 1–4 used for the golf balls of Comparative Examples 1–4. Comparative Preparation 1 is a cover composition used for general hard ionomer, Comparative Preparations 2–3 are the soft cover composition containing soft terpolymer base ionomer disclosed in Japanese Patent Application Laid Open No. Hei 308577, and Comparative Preparation 4 is a cover composition containing a soft ionomer obtained by modifying styrene-hydrogenated butadiene-styrene-block copolymer elastomer with maleic anhydride.

(3) Production of golf balls

From the cover compositions prepared in the process (2), semi-spherical half shells were formed, respectively, and they were covered on the thread-wound core prepared in the process (1) and press-molded in a mold to form a golf ball. The resulting golf ball was coated with a paint to obtain a thread wound golf ball having a diameter of 42.7 mm.

The weight, compression, impact resilience coefficient, and distance of carry were measured on the golf balls obtained, and the hit feeling and controllability were also investigated. Compression was determined by the PGA system. The impact resilience coefficient was determined by measuring the ball speed when a metal cylinder weighing 198.4 g was allowed to collide with the ball at a speed of 45 m/s using an R&A initial speed measuring machine and computing from the ball speed. The temperature when the ball speed was measured was 23° C. A distance of carry was measured by hitting the ball with a number 1 wood at a head speed of 45 m/s by using a swing robot of True Temper Company.

The hit feeling and controllability were evaluated by actually hitting balls using a number 1 wood by 10 top professional golfers, and the results were classified into the following three groups. In indicating the evaluation results in the table, the same symbols are used, indicating that 8 or more professional golfers out of 10 gave the same evaluation results.

Evaluation standard:

○: Good with hit feeling and controllability similar to those of the balata cover.

Δ: Controllability close to that of the balata cover but far different hit feeling, That is, so hard as to result in excessively strong impact or so soft as to cause heavy feeling.

X: Poor both in hit feeling and controllability.

Table 3 and Table 4 show measurement results of weight, compression, impact resilience coefficient, and distance of carry of golf balls of Examples 1–6 and Comparatives 1–4 as well as evaluation results of hit feeling and controllability, and the cover compositions used in manufacturing However, the cover compositions are indicated by respective Preparation Example No. and Comparative Preparation No.

TABLE 1

| | | Preparation Examples | | | | | |
|---|---|---|---|---|---|---|---|
| | | 1 | 2 | 3 | 4 | 5 | 6 |
| Zinc sulfate attached EPDM A (Zinc sulfate ≈ 1.2 mol %) | *1 | 30 | 30 | 25 | 40 | 0 | 0 |
| Zinc sulfate attached EPDM B (Zinc sulfate ≈ 0.7 mol %) | *2 | 0 | 0 | 0 | 0 | 30 | 0 |
| Styrene-hydrogenated butadiene-styrene block copolymer elastomer having zinc sulfate (Zinc sulfate ≈ 1.2 mol %) | *3 | 0 | 0 | 0 | 0 | 0 | 30 |
| Hi-milan 1605 | *4 | 35 | 15 | 30 | 30 | 35 | 35 |
| Hi-milan 1706 | *5 | 35 | 35 | 30 | 30 | 35 | 35 |
| Surlyn 7940 | *6 | 0 | 20 | 0 | 0 | 0 | 0 |
| Hi-milan 1855 | *7 | 0 | 0 | 15 | 0 | 0 | 0 |
| Zinc stearate | | 1.2 | 1.2 | 1.0 | 1.6 | 1.2 | 1.2 |
| Titanium dioxide | | 2.0 | 2.0 | 2.0 | 2.0 | 2.0 | 2.0 |
| Stiffness modulus (Mpa) | | 150 | 160 | 160 | 130 | 140 | 170 |
| Shore D hardness | | 48 | 49 | 51 | 47 | 47 | 50 |

TABLE 2

| | | Comparative Preparation Examples | | | |
|---|---|---|---|---|---|
| | | 1 | 2 | 3 | 4 |
| Hi-milan 1605 | | 50 | 20 | 20 | 35 |
| Hi-milan 1706 | | 50 | 20 | 20 | 35 |
| Surlyn AD8265 | *8 | 0 | 60 | 0 | 0 |
| Surlyn AD8269 | *9 | 0 | 0 | 60 | 0 |
| Zinc neutralized maleic anhydride modified styrene-hydrogenated butadiene-styrene block copolymer elastomer | *10 | 0 | 0 | 0 | 30 |
| Titanium dioxide | | 2.0 | 2.0 | 2.0 | 2.0 |
| Stiffness modulus (Mpa) | | 340 | 120 | 90 | 150 |
| Shore D hardness | | 63 | 56 | 50 | 48 |

*1: Zinc sulfate added EPDM A

It was prepared by attaching sulfonic acid group to commercially available EPDM (commercially available from Exxon Chemical as VISTALON-2504, containing about 50% propylene with Mooney viscosity ML1+4 (125° C.)=26) and neutralizing with zinc ion in the method specified below.

Acetic acid anhydride and concentrated sulfuric acid were added to an n-hexane solution of EPDM and stirred for 30 minutes at room temperature. This was neutralized by adding a water—methanol solution of zinc acetate. Thereafter, the antioxidant IRGANOX 1010 (product name) was added 0.5% by weight, the solvent was removed by evaporation, and the mixture was poured into boiling water and dried by roll mixing. Acetic acid anhydride and concentrated sulfuric acid were added in a hexane/isopropyl alcohol=100/15 (weight ratio) solution.

Each reacting component was added in an amount of 3.7 g of sulfuric acid, 1.8 g of acetic anhydride, and 6.6 g of zinc acetate with respect to 100 g of EPDM, and as a result, desired sulfonate-type ionomer of EPDM having about 1.2 mol% of sulfonic acid group neutralized with 100% zinc ion was obtained. EPDM is an abbreviation of ethylene-propylene-diene monomer copolymerized elastomer, and Table 1 refers the sulfonate-type ionomer as zinc sulfate attached EPDM A from the viewpoint of the space allowed.

*2: Zinc sulfate added EPDM B

Using EPDM same as in the case of Note *1 above, the EPDM was prepared in the same method. However, in order to achieve 0.7 mol% for the content of zinc sulfonate (concentration of sulfonic acid group which was neutralized with zinc ion), the ratio of acids and zinc acetate to 100 g of EPDM was changed as follows:

EPDM/sulfuric acid/acetic anhydride/zinc acetate ≈100/2.2/11/3.9 (weight ratio), and Table 1 shows the sulfonate-type ionomer as zinc sulfonate attached EPDM B.

*3: Styrene-hydrogenated butadiene-styrene block copolymer elastomer having zinc sulfonate group The elastomer was prepared in the same method as in the case of Note *1. However, for the base polymer, commercially available styrene-hydrogenated butadiene-styrene block copolymer thermoplastic elastomer [available from Asahi Chemical Industry as TOUGHTEC H1052 (product name), styrene-to-hydrogenated butadiene ratio=20-to-80, hardness (JIS-A)=67] was used. The ratio of reacting components is TOUGHTEC H1052/sulfuric acid/acetic anhydride/zinc acetate ≈ 100/2.0/1.0/3.9 (by weight), and ionomer having 1.2 mol% of sulfonic acid group neutralized with zinc ion was obtained. Table 1 shows the sulfonate-type ionomer as added styrene-hydrogenated butadiene-styrene block copolymer elastomer having zinc sulfate.

*4: Hi-milan 1605

Product name, available from Mitsui du Pont Poly Chemicals Company Ltd., sodium ion neutralized ethylene-methacrylate type ionomer, MI (melt index)=2.8, stiffness modulus=310 MPa.

*5: Hi-milan 1706

Product name, available from Mitsui du Pont Poly Chemicals Company Ltd., zinc ion neutralized ethylene-methacrylate type ionomer, MI (melt index)=0.8, stiffness modulus=260 MPa.

*6: Surlyn 7940

Product name, available from du Pont USA, lithium ion neutralized ethylene-methacrylate type ionomer, MI (melt index)=2.8, stiffness modulus=350 MPa.

*7: Hi-milan 1855

Product name, available from Mitsui du Pont Poly Chemicals Company Ltd., zinc ion neutralized ethylene-butyl acrylate-methacrylate ternary copolymer soft ionomer, MI (melt index)=1.6, stiffness modulus=90 MPa.

*8: Surlyn AD8265

Product name, available from du Pont USA, sodium ion neutralized ethylene-butyl acrylate-methacrylate ternary copolymer soft ionomer, MI (melt index)=1.0, stiffness modulus=55 MPa.

*9: Surlyn AD8269

Product name, available from du Pont USA, sodium ion neutralized ethylene-butyl acrylate-methacrylate ternary copolymer soft ionomer, MI (melt index)=1.0, stiffness modulus=26 MPa.

*10: Zinc neutralized maleic anhydride modified styrene-hydrogenated butadiene-styrene block copolymer elastomer Commercially available maleic anhydride modified styrene-hydrogenated butadiene-styrene block copolymer elastomer (available from Asahi Chemical Industry Co. Ltd. as Toughtec M1943 (product name), ratio of styrene to hydrogenated butadiene=20 to 80, hardness (JIS-A)=67, acid value=10 mg·$CH_3$ ONa/g) was Brabender mixed and kneaded, had basic zinc carbonate and a trace of moisture mixed at 230° C., and was mixed to make about 50%-neutralized zinc ion neutralized substance.

TABLE 3

| | Examples | | | | | |
|---|---|---|---|---|---|---|
| | 1 | 2 | 3 | 4 | 5 | 6 |
| Cover composition | Pre. Ex. 1 | Pre. Ex. 2 | Pre. Ex. 3 | Pre. Ex. 4 | Pre. Ex. 5 | Pre. Ex. 6 |
| Ball weight (g) | 45.4 | 45.3 | 45.3 | 45.4 | 45.4 | 45.4 |
| Compression | 90 | 92 | 91 | 88 | 89 | 93 |
| Impact resilience coefficient | 0.784 | 0.785 | 0.784 | 0.783 | 0.783 | 0.785 |
| Carry (yard) | 230 | 231 | 230 | 229 | 229 | 232 |
| Hit feeling and controllability | o | o | o | o | o | o |

TABLE 4

| | Comparative Examples | | | |
|---|---|---|---|---|
| | 1 | 2 | 3 | 4 |
| Cover composition | Comp. Pre. Ex 1 | Comp. Pre. Ex. 2 | Com. Pre. Ex. 3 | Comp. Pre. Ex. 4 |
| Ball weight (g) | 45.4 | 45.3 | 45.3 | 45.3 |
| Compression | 95 | 92 | 88 | 90 |
| Impact resilience coefficient | 0.784 | 0.770 | 0.765 | 0.773 |
| Carry (yard) | 230 | 223 | 222 | 223 |
| Hit feeling and controllability | x | Δ | Δ | o |

As clear from the results shown in Table 3 and 4, the golf balls of Examples 1–6 exhibited a high impact resilience coefficient and a long carry of the nearly same level as those of golf balls of Comparative 1 using a hard ionomer cover. In contrast, the golf balls of Comparatives 2–3 using the cover containing the soft terpolymer base ionomer or those of Comparative 4 using the covers containing the maleic anhydride modified soft ionomer exhibited smaller impact resilience coefficient and shorter carry.

The golf balls of Examples 1–6 exhibited excellent evaluation results on hit feeling and controllability nearly equivalent to those of thread-wound golf balls covered with balata covers, but the golf balls of Comparative 1 using the hard ionomer covers provided hard hit feeling and poor controllability. The golf balls of Comparatives 2–3 provided good controllability but too soft and heavy hit feeling, and no satisfactory results were obtained.

In addition, to further investigate the cut resistance of the golf balls of Examples 1–6 and Comparatives 1–4, a pitching wedge was installed to a True Temper's swing robot and balls were topped at the speed of 30 m/s and the conditions for generating cut damages were investigated.

As a result, no cut damage was generated on the golf balls of Examples 1–6 and Comparative 1 but small cut damages were generated in the golf balls of Comparatives 2–4.

With respect to thread-wound golf balls covered with a balata cover, the cut resistance was investigated under the same conditions, and a large cut damage which prevents the gold ball from being further used was generated.

Examples 7–12 and Comparative Examples 5–8 (Two-piece Solid Golf Balls)

(1) Preparation of cores

Solid cores were obtained by mixing 100 parts by weight of cis-1,4-polybutadiene rubber (BR-1 available from Japan Synthetic Rubber Co. Ltd.), 36 parts by weight of zinc acrylate, 20 parts by weight of zinc oxide, 1.2 parts by weight of dicumyl peroxide, and 0.5 parts by weight of antioxidant (available from Yoshitomi Seiyaku Company as YOSHINOX 425) to form a rubber composition which was then vulcanizing molded at a temperature of 160° C. for 25 minutes. The average diameter of the solid cores thus obtained was 38.2 mm.

(2) Cover compositions

The pellet-form cover covers prepared in above-mentioned examples 1–6 and Comparative 1–4 were used.

(3) Production of golf balls

The cover composition of the process (2) above were covered directly over the solid cores of the process (1) above by injection molding, and paint was applied on the surfaces, and two-piece solid golf balls having a diameter of 42.7 mm were obtained.

The weight, compression, impact resilience coefficient, and carry of the balls were measured and the hit feeling and controllability were also investigated. Table 5 and Table 6 show the results of physical properties and evaluation results of hit feeling and controllability of the golf balls of Examples 7–12 and Comparatives 5–8 together with the type of composites for covers used. However, the composites for covers are shown by Example No. and Comparative No., respectively.

TABLE 5

| | Examples | | | | | |
|---|---|---|---|---|---|---|
| | 7 | 8 | 9 | 10 | 11 | 12 |
| Cover composition | Pre. Ex. 1 | Pre. Ex. 2 | Pre. Ex. 3 | Pre. Ex. 4 | Pre. Ex. 5 | Pre. Ex. 6 |
| Ball weight (g) | 45.5 | 45.4 | 45.4 | 45.5 | 45.5 | 45.4 |
| Compression | 93 | 95 | 94 | 92 | 93 | 95 |
| Impact resilience coefficient | 0.784 | 0.786 | 0.785 | 0.783 | 0.784 | 0.786 |
| Carry (yard) | 234 | 236 | 235 | 234 | 234 | 237 |
| Hit feeling and controllability | o | o | o | o | o | o |

TABLE 6

| | Comparative Examples | | | |
|---|---|---|---|---|
| | 5 | 6 | 7 | 8 |
| Cover composition | Comp. Pre. Ex. 1 | Comp. Pre. Ex. 2 | Comp. Pre. Ex. 3 | Comp. Pre. Ex. 4 |
| Ball weight (g) | 45.4 | 45.5 | 45.5 | 45.4 |
| Compression | 103 | 95 | 92 | 94 |
| Impact resilience coefficient | 0.786 | 0.773 | 0.769 | 0.775 |
| Carry (yard) | 235 | 226 | 225 | 228 |
| Hit feeling and controllability | x | Δ | Δ | o |

As clear from the results shown in Table 5 and 6, in these two-piece solid golf balls, the golf balls of Examples 7–12 exhibited a long carry and outstanding hit feeling and controllability as in the case of thread-wound golf balls of above-mentioned examples 1–6.

That is, the golf balls of Examples 7–12 provided a carry as long as 234–237 yards, exhibiting a long carry nearly equivalent to the golf ball of Comparative 5 which only uses hard ionomer for cover base material. The golf balls of Examples 7–12 were given acceptable evaluation results on hit feeling and controllability, ensuring excellent hit feeling and controllability similar to balata covers.

In addition, the cut resistance was investigated on the golf balls of Examples 7–12 in the same manner as done for Examples 1–6, and as a result, no cut damage was generated on any golf balls, providing outstanding cut resistance.

On the other hand, the golf balls of Comparative 5 provided good flying performance and cut resistance, but poor hit feeling or controllability, and the golf balls of Comparatives Examples 6–7 provided not so bad hit feeling and controllability, but achieved a carry 6–12 yards inferior to those of Examples 7–12.

As described above, according to the present invention, golf balls with a long carry as well as outstanding hit feeling and controllability can be provided.

What is claimed is:

1. A golf ball comprising a core and a cover for covering said core, wherein said cover has a stiffness modulus of 100–250 MPa and a Shore D hardness of 40–55, and said cover comprises, as a base component, a mixture of a sulfonate-type ionomer of which a polymer chain contains an elastomeric portion having rubber resilience and has a sulfonic group neutralized by a metallic ion, and a carboxylate type ionomer which is a copolymer of at least α-olefin and α,β-unsaturated carboxylic acid of which a carboxyl group is neutralized by a metallic ion.

2. A golf ball according to claim 1 wherein a mixture ratio of sulfonate-type ionomer to carboxylate-type ionomer is 10:90–60:40 by weight.

3. A golf ball according to claim 1 wherein said sulfonate-type ionomer is selected from the group consisting of an ethylene-propylene-diene monomer copolymer elastomer having a sulfonic acid group neutralized by a metallic ion, a styrene-hydrogenated butadiene-styrene block copolymer thermoplastic elastomer having a sulfonic acid group neutralized by a metallic ion, or a styrene-hydrogenated isoprene-styrene block copolymer thermoplastic elastomer having a sulfonic acid group neutralized by the metallic ion.

* * * * *